US008763196B2

(12) United States Patent
Kraemer

(10) Patent No.: US 8,763,196 B2
(45) Date of Patent: Jul. 1, 2014

(54) TOOTHBRUSH INCORPORATING A FLEXIBLE UNDULATING REGION

(75) Inventor: Hans Kraemer, Buehl (DE)

(73) Assignee: GlaxoSmithKline Consumer Healthcare GmbH & Co., Buehl (Baden) (DE)

( * ) Notice: Subject to any disclaimer, the term of this patent is extended or adjusted under 35 U.S.C. 154(b) by 0 days.

(21) Appl. No.: 13/412,971

(22) Filed: Mar. 6, 2012

(65) Prior Publication Data

US 2012/0227200 A1 Sep. 13, 2012

(30) Foreign Application Priority Data

Mar. 9, 2011 (GB) ..... 1104024.3

(51) Int. Cl.
*A46B 9/04* (2006.01)

(52) U.S. Cl.
USPC ..... 15/167.1; 15/172

(58) Field of Classification Search
USPC ..... 15/167.1, 172
See application file for complete search history.

(56) References Cited

U.S. PATENT DOCUMENTS

| | | | | |
|---|---|---|---|---|
| 5,054,154 | A | 10/1991 | Schiffer et al. | |
| 5,758,383 | A | 6/1998 | Hohlbein | |
| 5,903,949 | A * | 5/1999 | Halm | 15/167.1 |
| 6,101,659 | A | 8/2000 | Halm | |
| D450,928 | S | 11/2001 | Weisbarth | |
| 6,675,428 | B2 * | 1/2004 | Halm | 15/167.1 |
| 6,990,706 | B2 * | 1/2006 | Broecker et al. | 15/167.1 |
| 8,046,864 | B2 * | 11/2011 | Baertschi et al. | 15/167.1 |

FOREIGN PATENT DOCUMENTS

| | | |
|---|---|---|
| CA | 2 004 029 A1 | 5/1990 |
| EP | A 0 336 641 A | 3/1989 |
| EP | A-11350442 | 6/1989 |
| WO | WO 96/28993 | 9/1996 |
| WO | WO 97/25899 | 7/1997 |
| WO | WO 98/05241 | 2/1998 |
| WO | WO 98/37788 | 9/1998 |
| WO | WO 01/43580 | 6/2001 |
| WO | WO2008/025443 A1 | 3/2008 |

* cited by examiner

*Primary Examiner* — Randall Chin

(74) *Attorney, Agent, or Firm* — Joshua C. Sanders; Theodore R. Furman

(57) ABSTRACT

A toothbrush wherein longitudinally between its neck region and the grip handle is a an undulating region of transverse limbs integrally linked by folds with troughs between the limbs, the troughs containing a thermoplastic elastomer material bonded to the plastic material of said limbs with a ShoreA hardness of 60-70. Specific structures and dimensions of limbs and folds are disclosed.

14 Claims, 3 Drawing Sheets

TOOTHBRUSH INCORPORATING A FLEXIBLE UNDULATING REGION

CROSS REFERENCE TO PRIOR APPLICATIONS

This application claims the priority of GB 1104024.3 filed 9 Mar. 2011, which is incorporated herein in its entirety.

TECHNOLOGY FIELD

This invention relates to toothbrushes, in particular to toothbrushes having a flexible region in their handle.

BACKGROUND

Toothbrushes generally comprise a head and a grip handle arranged to define a toothbrush longitudinal direction (not necessarily a straight line) between them, with a neck region longitudinally between the grip handle and the head. Typically toothbrush handles and heads are made of a hard plastic material such as polypropylene. Tooth-cleaning elements such as bristles, e.g. typically filaments made from nylon, are mounted in the head and project in a transverse direction relative to this longitudinal direction from the head.

It is known to provide toothbrushes with a resiliently flexible region in their structure to absorb excessive brushing pressures during use and thereby reduce the likelihood of damage to teeth and soft oral tissues such as gums resulting from such excessive pressure. U.S. Pat. No. 5,054,154 discloses a toothbrush with an elastic segment between its handle and its head, in the form of widthways cut-outs across the toothbrush containing an elastic rubbery material. Another known form of such a flexible region is that disclosed in EP-A-0 336 641A being in the form of an S-bend undulating region longitudinally between the head and the handle, comprising limbs extending in the transverse direction and integrally linked by folds with troughs between the limbs, and preferably made more rigid by means of a longitudinal rib through the folds. A modification of such a region of limbs and folds is disclosed in WO-A-01/43580 in which there is a thermoplastic elastomer material in the folds between the limbs, and in which the flexibility can be controlled by a longitudinally moveable slider which intersects the limbs.

Since these early publications toothbrushes have been sold by the present applicant under the trademarks AQUAFRESH™ and DrBEST™ incorporating such an undulating region and attempting to optimize flexibility. The solution adopted in such commercial embodiments has always been the incorporation of a longitudinal rib as described in EP-A-0 336 641. Such toothbrushes have also been sold incorporating additionally a flexible link between the toothbrush head and the neck region of the toothbrush, or located in the neck region of the toothbrush itself. Such toothbrushes are for example disclosed in WO-A-98/37788.

The incorporation of elastomer material parts into toothbrush heads and handles to modify flexibility and for other purposes is also known. For example WO-A-96/28993 discloses an S-bend undulating region longitudinally penetrated by an elastomer material core. WO-A-97/25899 discloses elastomer segments in the toothbrush head to modify flexibility and in the handle to enhance grip and for aesthetic purposes. WO-A-98/05241 discloses elastomer-filled grooves in a toothbrush head to modify flexibility. EP-A-1350442 discloses a toothbrush head made flexible by means of an elastomer-containing hinge. US-D-450928 S discloses a toothbrush handle with an S-bend undulating region in which the troughs of the S-bend undulating region contain an elastomer material, but for an undisclosed technical purpose.

A problem has been encountered with toothbrushes incorporating such an undulating region, especially such toothbrushes which also include the above-mentioned flexible link between the toothbrush head and the neck region of the toothbrush. The problem is that with the prior undulating region incorporating the longitudinal rib the stress experienced by the toothbrush during tooth brushing is not optimally distributed and the toothbrush is prone to breakage during use. In toothbrushes which also include a flexible link between the toothbrush head and the neck region of the toothbrush it has been found that undulating regions of limbs and folds can be so rigid that the flexible link between the toothbrush head and the neck region can be subject to excessive stress during use, resulting in breakage and shortening of useful life. It is an object of the present invention to address these problems. Other objects and advantages of the present invention will be apparent from the following description.

SUMMARY

According to this invention a toothbrush is provided comprising a head and a grip handle integrally made of a plastics material and arranged along a head-handle longitudinal direction, with a neck region between the grip handle and the head, with bristles projecting from the head in a transverse direction relative to this longitudinal direction, the toothbrush having a width direction perpendicular to the longitudinal direction and to the transverse direction, wherein longitudinally between the neck region and the grip handle is an undulating region, comprising limbs extending in the transverse direction and integrally linked by folds with troughs longitudinally between the limbs, the troughs between the limbs having a transverse depth direction and containing a thermoplastic elastomer material bonded to the plastics material of said limbs, characterized in that the thermoplastic elastomer material has a ShoreA hardness of 60-70.

It is inventively found that use of such a thermoplastic elastomer material optimizes the resilient flexibility of the undulating region, especially in the proportions referred to above.

Preferably there are four such limbs.

Preferably the thermoplastic elastomer material occupies at least 60% of the depth "D" and at least 60% of the width of at least one, preferably each, trough, more preferably 75-90% of the depth "D" and 75-90% of the width. Preferably the thermoplastic elastomer material occupies at least 60% of the volume of at least one, preferably each, trough, more preferably 65-80%.

The term "transverse" as used herein includes perpendicular, and refers to a direction at an angle between 45° and 90° to the longitudinal direction. Preferably the transverse directions, i.e. the direction of a plane midway between longitudinally opposite surfaces of the limb, of longitudinally adjacent pairs of limbs are aligned at an angle of 0-15° to each other.

Preferably each of the four limbs has a longitudinal thickness "T" of 1.2-2.2 mm, and a transversely extending length "L" of 9-13 mm between transversely opposite folds, and a width "W" of 9-14 mm in the width direction, the four limbs defining longitudinally between longitudinally adjacent pairs of the limbs three troughs each with a transverse depth "D" of 6-11 mm, a longitudinal breadth "B" of 1-2 mm for at least 60% of the lower depth of the trough, each trough containing the thermoplastic elastomer material of ShoreA hardness 60-70 bonded to the plastic material of the limbs between which the trough is situated.

It is inventively found that such alignments, dimensions and proportions optimize the resilient flexibility of the undulating region, without any need for a longitudinally extending rib penetrating the limbs to modify the flexibility of the undulating region. Such optimization of flexibility is relative to the ability of the toothbrush to resiliently absorb excessive toothbrushing pressures whilst also being ergonomically rigid and providing the user with a sense of "feedback" through the handle during use.

Typically the toothbrush of this invention has a length of 190-200 mm from the extreme longitudinal end of its grip handle to the extreme opposite longitudinal end of its head.

Typically the head has a length of 33-35 mm from the point where the neck region begins to widen widthways to form the head to the end of the head longitudinally furthest from the grip handle.

Typically the grip handle has a length of 105-115 mm from the longitudinal end of the grip handle remotest from the head to the start of the undulating region.

Typically the undulating region has an overall length of 15-20 mm.

Typically the neck region has a length of 30-40 mm from the end of the undulating region closest to the head to the point where the neck region begins to widen widthways to form the head. Typically the neck region may have a thickness in the transverse direction of 5.5-3.5 mm, and typically the thickness may taper, decreasing toward the toothbrush head. The cross section of the neck region may be any convenient or conventional shape, e.g. semicircular, rectangular (optionally with rounded corners). The neck region may incorporate longitudinal flow channels to enable elastomer injected at points adjacent the handle during an injection moulding manufacturing process to flow along the neck toward the head, or vice versa.

Preferably the transverse directions of longitudinally adjacent pairs of limbs are aligned at an angle of 7-10° to each other. The transverse directions may be parallel to each other.

Preferably as viewed in the longitudinal direction the limbs may have a generally rectangular (the term includes square) shape, preferably with rounded corners.

In a preferred embodiment the longitudinal thickness "T" of the limbs is 1.5-2.0 mm.

In another preferred embodiment the transversely extending length "L" of the limbs is 9-12 mm between the extremities of transversely opposite folds.

In another preferred embodiment the width "W" of the limbs is 9-12 mm in the width direction. Suitably the width W of the limbs decreases toward the head of the toothbrush. For example the two limbs closest to the handle of the toothbrush may have substantially the same width "W", and the two limbs closer to the head may be progressively less wide. Such narrowing of the width may improve the flexibility of the undulating region by concentrating flexibility at the end of the undulating region closest to the toothbrush head at which pressure is applied during tooth brushing.

In another preferred embodiment, the depth "D" of the troughs is 6-11 mm. For example the three troughs may vary in depth, with the longitudinally middle of the three troughs being the deepest.

In another preferred embodiment the longitudinal breadth "B" of the troughs tapers, narrowing toward the bottom of the trough, and being 1-1.5 mm for at least 60% of the depth of the trough.

In a preferred embodiment the folds are in the form of an arc of a circle with an outer radius of curvature defining the extremity of the fold of 2.0-2.5 mm, more preferably 2.25-2.35 mm. In a preferred embodiment the thickness of the folds in the radial direction is 1.5-2.0 mm. It is found that such a radius of curvature and thickness of the folds can optimize the flexibility of the undulating region whilst reducing the tendency for the undulating region to break during use.

In a preferred embodiment, at each longitudinal end of the undulating region there is an end trough in the plastics material, bounded on one longitudinal side by an adjacent limb and on the other longitudinal side by an adjacent surface of the grip handle or head, these end troughs also containing the thermoplastic elastomer material of ShoreA hardness 60-70 and bonded to the plastic material.

Such an end trough can act as a force-absorbing buffer between the neck region at one longitudinal end of the undulating region, and the grip handle at the other. Preferably such end troughs may have a transverse depth "E" of 5-7 mm, a longitudinal breadth "B" of 1-2 mm for at least 60% of the lower depth of the trough. Preferably the thermoplastic elastomer material occupies at least 60% of the transverse depth "D" and at least 60% of the width of each trough.

The neck region is preferably flattened in the transverse direction. Typically the neck region has a thickness "TN" in the transverse direction of 3.5-4.5 mm, for example ca. 4.0 mm. Typically the neck region has a width in the range 5-10 mm, and typically the neck tapers, narrowing toward the head, for example ca. 9.5 mm wide at its end closest to the undulating region and ca. 6.0 mm at the point where the neck region begins to widen widthways to form the head. Various cross sectional shapes as cut across the longitudinal direction may be used for the neck region, for example rectangular, trapezoidal, semicircular, or such aforementioned shapes cut into by longitudinally extending moulding channels for the flow of fluid elastomer material during an injection moulding process in which thermoplastic elastomer is injected to form spaced apart thermoplastic elastomer parts of the toothbrush.

In a preferred embodiment the toothbrush of the invention also includes a flexible link situated longitudinally between the undulating region and the toothbrush head.

Preferably such a flexible link is situated in the neck region thereby dividing the neck region into two longitudinally separate parts, one on each longitudinal side of the flexible link, being a first part closer to the grip handle and a second part closer to the head. The relative longitudinal proportions of the first part:second part may suitably be in the range 8.5-8.0:1. Such proportions have been found to optimize the distribution of forces between the flexible undulating region and the flexible link.

Suitably such a flexible link comprises a thinned part, integral with the neck region, which is transversely and/or widthways thinned relative to longitudinally immediately adjacent parts of the neck region or relative to longitudinally immediately adjacent parts of the neck region and the toothbrush head.

Alternatively such a flexible link may be situated between the neck region and the toothbrush head. Suitably such a flexible link comprises a part, integral with the neck region and toothbrush head, which is transversely and/or widthways thinned relative to longitudinally immediately adjacent parts of the neck region and toothbrush head.

Preferably the thinned part is in the form of a longitudinally extending spine of plastics material having a longitudinal dimension of 1-2 mm, a widthways dimension of 2-3 mm, and a transverse dimension of 1.5-2.5 mm. Suitably the cross section of such a spine cut across its longitudinal direction is circular or oval.

In a preferred embodiment such a spine is surrounded around all of its transversely- and widthways-facing surfaces by a thermoplastic elastomer material, suitably having a spherical symmetry, suitably with a spherical diameter of 6-7 mm. Suitably such a thermoplastic material may be the same thermoplastic elastomer material that is situated in the troughs, so that the same thermoplastic elastomer material may be used in all locations. This may be achieved by providing one or more flow channel in the plastic material of the toothbrush via which thermoplastic elastomer material injected at an injection port in an injection mould enclosing the plastic material part of the toothbrush may flow from one location to the other. The use of such flow channels to convey thermoplastic elastomer from one location on a toothbrush to another during manufacture is conventional in the toothbrush art. Alternatively multiple injection points may be used to inject the thermoplastic elastomer material into separated positions on the toothbrush.

In a preferred embodiment the end of such a flexible link closest to the undulating region is located within 30 mm of the end of the undulating region closest to the undulating region.

When the toothbrush of this invention includes such a flexible link it is preferred that the part of the neck region between the flexible link and the undulating region (herein the "first part") is constructed such that under the forces encountered during tooth brushing this first part remains rigid relative to the flexibility of the flexible link and the undulating region. For example this may be provided by a first part which has a transverse thickness of at least 3.5 mm, preferably at least 4 mm, and a widthways width of at least 5 mm, preferably at least 5.5 mm. Such a construction helps to transmit force from the toothbrush head to the undulating region during use, so that the undulating region can absorb much of the forces of toothbrushing and protect the flexible link when present from such forces to thereby reduce the likelihood of breakage of the flexible link.

It is found that the above-mentioned dimensions and construction can provide a toothbrush in which flexibility during tooth brushing is improved relative to known toothbrushes, and in which the tendency to break of a flexible link in the neck region is reduced. It is believed that this advantage is achieved by means of the above-mentioned S-bend undulating region having an optimized flexibility which spreads stress out along the toothbrush, reducing breaking stress in the region of the flexible link.

Suitable plastic materials for the toothbrush of this invention include those with a modulus of elasticity of at least about 500 Mpa, preferably at least about 1000 Mpa, these being conventional in the toothbrush art. Suitable materials include for example, polyamides and polypropylenes. An example of a suitable polyamide is the material Ultramid B3™ (marketed by BASF, Federal Republic of Germany), having a modulus of elasticity (DIN 53452) of 3000. An example of a suitable polypropylene is the material Novolene 1100 HX™ (marketed by BASF, Federal Republic of Germany), which is a homopolymer and has a modulus of elasticity (DIN 53457) of 1400. Such a polypropylene homopolymer may optionally be used in admixture with a polypropylene block co-polymer, such as the material Novolene 2500 HX™ (marketed by BASF, Federal Republic of Germany), for example in an 80:20 mixture by weight (1100 HX:2500 HX). Other suitable polypropylenes include Polypropylene PM 1600™ (marketed by Shell) and having a modulus of elasticity (ISO 178) of 1500 Mpa and Apryl 3400 MAI™ from Elf Atochem, Novolen 2400 H and 1106, and Borealis HG 365 P. A preferred plastics material is polypropylene, especially the commercially available polypropylene material 100-GA04 supplied by Ineos.

Suitable thermoplastic elastomer materials for the toothbrush of this invention include those available under the trade names Megol™ and Santoprene™, and silicone elastomeric materials may also be used. Other suitable elastomeric polymers include styrene-based thermoplastic elastomers (for example styrene ethylene butadiene styrene, or styrene butadiene styrene). Preferred thermoplastic elastomer materials are the commercially available materials TF7 GST and TH7 GSN supplied by Kraiburg.

The toothbrush of this invention may be made using a known injection moulding process in which the plastics material part of the toothbrush is made in a first stage by injection moulding as an integral single part, and including one or more space defining the position and shape of the thermoplastic elastomer material part(s) of the toothbrush, including the position and shape of the thermoplastic elastomer material between the limbs. Then in a second stage the so formed plastics material part is enclosed in a cavity of a second injection mould which defines the outer profile of the thermoplastic elastomer part(s) of the toothbrush, including the shape of the thermoplastic elastomer material between the limbs. Thermoplastic elastomer material is then injected into the cavity of this second injection mould to thereby occupy the space(s) and thereby form the thermoplastic elastomer material part(s). Injection of this thermoplastic elastomer material is suitably under temperature and pressure conditions such that the thermoplastic elastomer material bonds tightly to the plastics material. Suitable temperature and pressure conditions are known in the art.

Bristles and/or other oral cleaning elements may be mounted in the head of the toothbrush of this invention in various known, conventional, ways. In one way socket holes may be formed in the plastics material of the head of the toothbrush during the first stage of injection moulding, and tufts of bristles may be held in these socket holes using small metal collars around the ends of the tufts in a well-known manner. In another way the ends of tufts of bristles may be inserted into the part of the cavity of the first injection mould which defines the toothbrush head, so that plastics material injected into the cavity flows around these ends, and when the plastics material solidifies around the ends of the tufts holds the tufts in place.

The toothbrush of this invention will now be described by way of example only with reference to the accompanying drawings.

DETAILED DESCRIPTION

Figure 1:
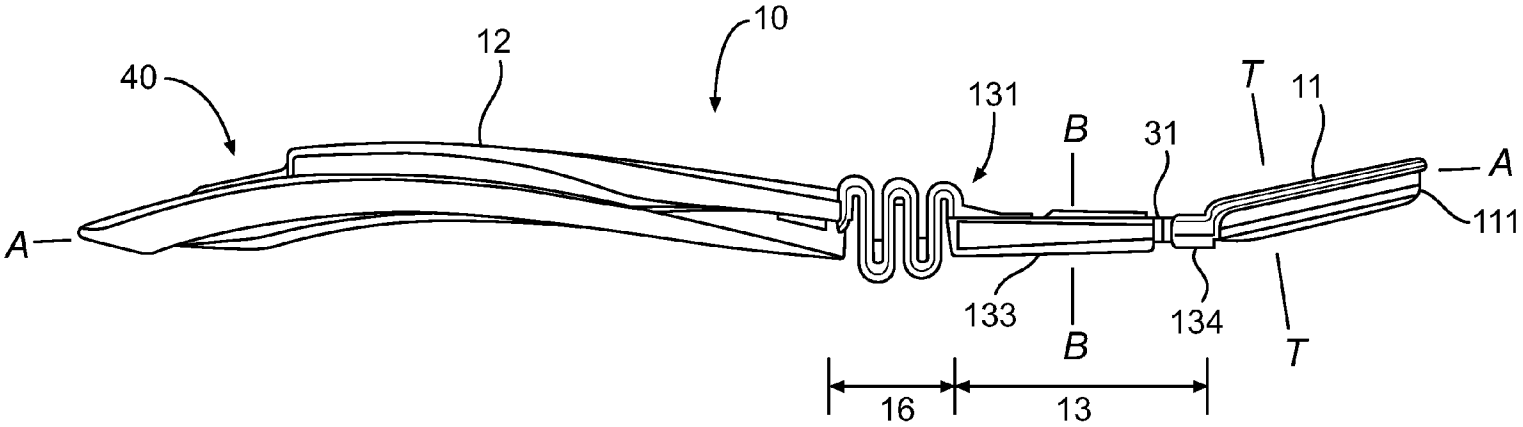
FIG. 1 shows a view of the plastic material part of a toothbrush of this invention looking in the width direction of the plastics material part, without any thermoplastic elastomer present.

Referring to FIGS. 1, 2, 3 and 4, the plastic material part 10 overall of a toothbrush 20 of the invention comprises the plastic part of a head 11 and of a grip handle 12 integrally made of a plastics material and arranged along a head-handle longitudinal direction A-A, with a neck region 13 between the grip handle 12 and the head 11. Holes 14 are formed in head 11 for mounting bristles 15 (shown in FIGS. 2 and 4, not shown in FIGS. 1 and 3) projecting from the head 11 in a transverse direction T-T transverse relative to longitudinal direction A-A. The toothbrush 10 has a width direction W-W indicated in the views of FIGS. 3 and 4 perpendicular to the longitudinal direction A-A and to the transverse direction T-T.

Figure 5:
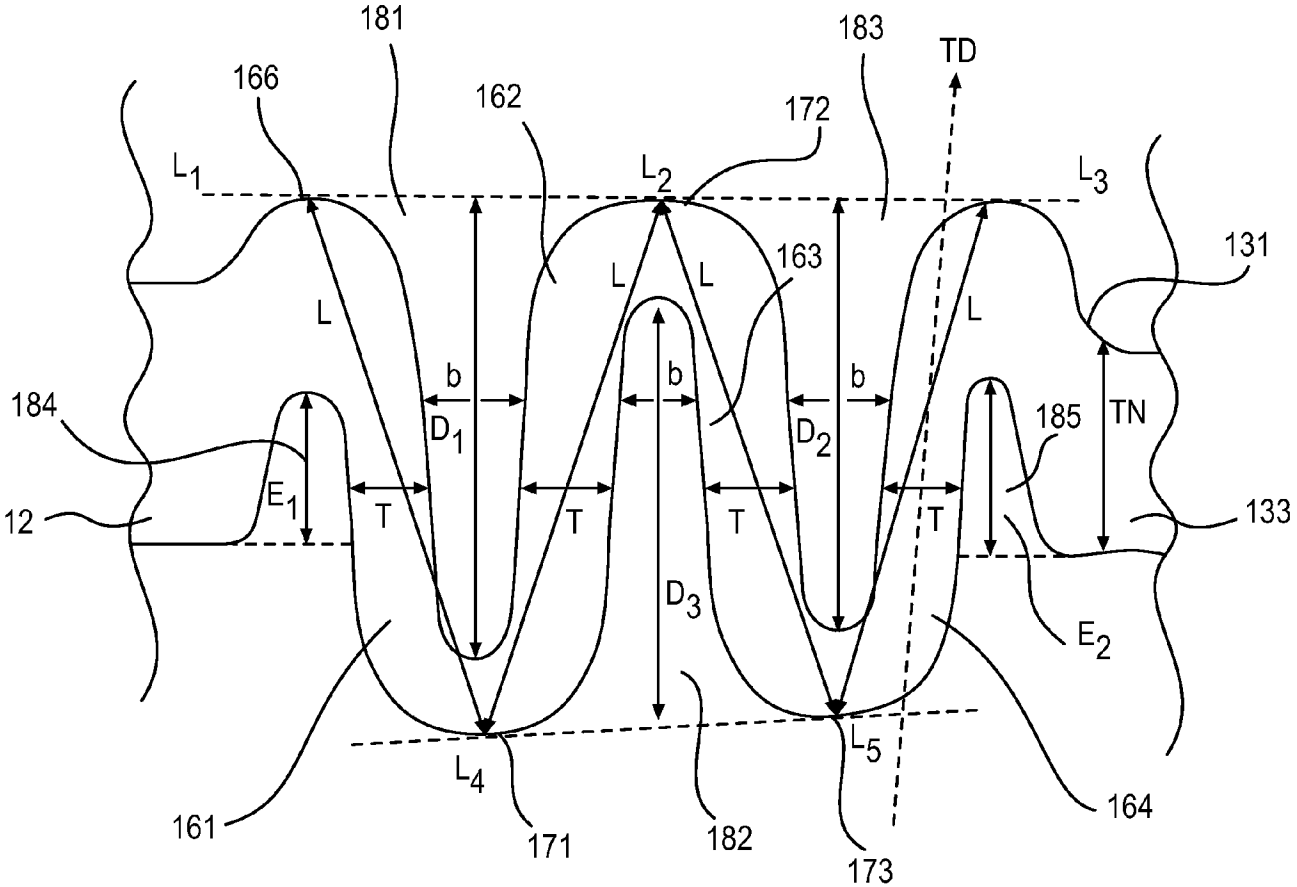
FIG. 5 is a view of the undulating region and flexible link of the plastic part shown in FIG. 1 enlarged to show more clearly the dimensions referred to in the description.

Longitudinally between the neck region 13 and the grip handle 12 is an undulating region 16. This region 16 is seen enlarged in FIG. 5 in the same view direction as FIG. 1. Undulating region 16 comprises four limbs 161, 162, 163, 164 extending in a transverse direction TD. The transverse direction TD is shown in FIG. 5 for limb 164, being the direction of a plane midway between the longitudinally opposite surfaces of the limb. Transverse directions of the other limbs 161, 162, 163 are analogous but are omitted for clarity. The limbs 161, 162, 163 and 164 are integrally linked by three folds 171, 172, 173 with a trough 181, 182, 183 longitudinally between longitudinally adjacent limbs 161, 162, 163, 164.

The toothbrush 20 of this invention has a length of ca. 195 mm from the extreme longitudinal end of its grip handle 12 to the extreme opposite longitudinal end of its head 11.

The head 11 has a length of ca. 34 mm from the point 132 where the neck 13 region begins to widen widthways to form the head 11 to the end 111 of the head 11 longitudinally furthest from the grip handle 12.

The grip handle 12 has a length of ca. 110 mm from the longitudinal end of the grip handle 12 remotest from the head 11 to the start of the undulating region 16.

The undulating region 16 has an overall length of ca. 17 mm.

The neck region 13 has a length of ca. 35 mm from the end 131 of the neck 13 closest to undulating region 16 to the point 132 where the neck region 13 begins to widen widthways to form the head 11. The neck region 13 is flattened in its transverse direction B-B. The thickness in the transverse direction B-B of the neck region is ca. 4.0 mm along its length, for example the thickness may be ca. 5 mm at the point 131 and ca. 4 mm at the point 132. The width of the neck 13 region tapers from ca. 9.5 mm wide at its end at the point 131 closest to the undulating region 16 to ca. 6.0 mm at the point 132 where the neck region 13 begins to widen widthways to form the head 11. The cross section of the neck region 13 as cut across the longitudinal direction A-A may for example be a generally rectangular shape, or for example be semicircular or other cross sectional shapes, and the neck region may include longitudinal flow channels for elastomer material.

Figure 3:
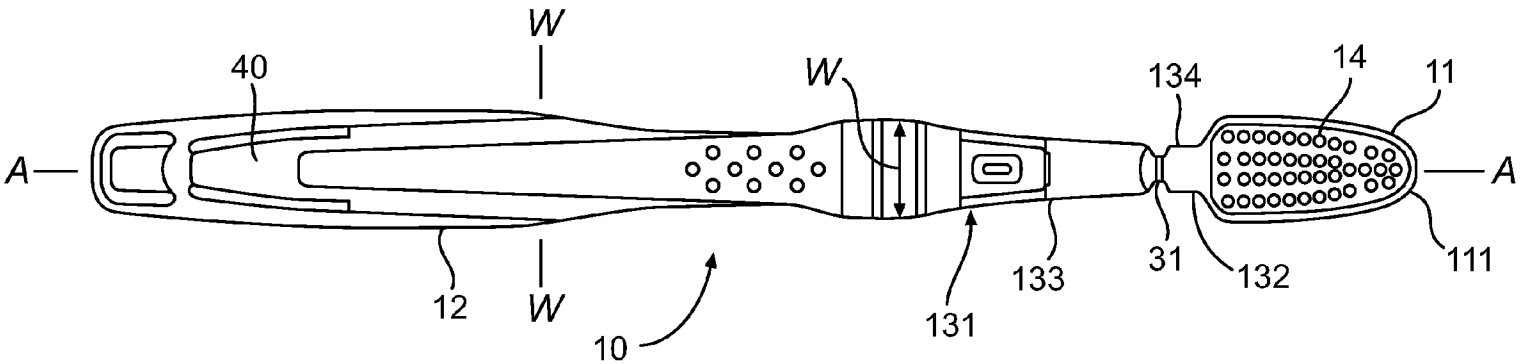
FIG. 3 shows a view of the plastic material part of FIG. 1 looking in a direction perpendicular to the longitudinal direction and to the width direction, in a transverse direction approximately aligned with the direction of the bristles.

As seen more clearly in FIG. 5, the transverse directions "TD" of longitudinally adjacent pairs of limbs 161, 162, 163, 164 are aligned at an angle of 7-10° to each other. As seen more clearly in FIG. 5 the longitudinal direction TD of each limb is constructed as the direction of a plane mid way between the two longitudinally opposite surfaces of the limb. Each of the four limbs 161, 162, 163, 164 has a longitudinal thickness "T" of 1.5-2.0 mm, and a transversely extending length "L" of 9-12 mm between transversely opposite folds 171, 172, 173, and between folds 171 and 173 and the adjacent edges of troughs 181, 183. Each of the four limbs 161, 162, 163, 164 has a width "W" of 9-12 mm in the width direction as indicated in FIG. 3. The width W of the folds 171, 172, 173 decreases toward the head 11. The two limbs 161, 162 closest to the handle 12 both have a width W of ca. 11.5 mm. The two limbs 163 and 164 progressively closer to the head 11 have respective widths 11.2 and 10.2 mm. As viewed in the longitudinal direction the limbs 161, 162, 163, 164 have a generally rectangular shape with rounded corners.

The three troughs 181, 182, 183 each have a transverse depth "D" of 6-9 mm. The measurement of the depths of the troughs 181, 182, 183 is seen most clearly in FIG. 5. The depth D1 of trough 181 is measured from the mid-point of line L1-L2, constructed between the outermost curve of the adjacent fold 172 and the adjacent edge 166 of the trough 181 to the bottom of the trough. The depth D2 of trough 182 is measured from the mid-point of line L3-L4, constructed between the outermost curves of the adjacent folds 171, 173 to the bottom of the trough 182. The depth D3 of trough 183 is measured from the mid-point of line L4-L5, constructed between the outermost curve of the adjacent fold 172 and the adjacent edge 167 of the trough 183 to the bottom of the trough 183.

The three troughs vary in depth. The trough 183 closest to the head 11 has a depth D3 of 7.0 mm, the middle trough 182 has a depth D2 of 10.0 mm, and the trough 181 closest to the grip handle 12 has a depth D1 8.0 mm, i.e. the middle trough 182 is the deepest.

The three troughs 181, 182, 183 have a longitudinal breadth "b" of 1-2 mm for at least 60% of the depth of each trough 181, 182, 183. The longitudinal breadth "b" tapers, narrowing toward the bottom of the trough 181, 182, 183, and being 1-1.5 mm for at least 60% of the depth of the trough 181, 182, 183.

Each of the folds 171, 172, 173 is externally in the form of an arc of a circle with an outer radius of curvature of 2.25-2.35 mm. The thickness of the folds measured in the radial direction of this circle is 1.5-2.0 mm.

The plastic material part 10 is made of the polypropylene plastics material 100-GA04 supplied by Ineos.

Figure 2:
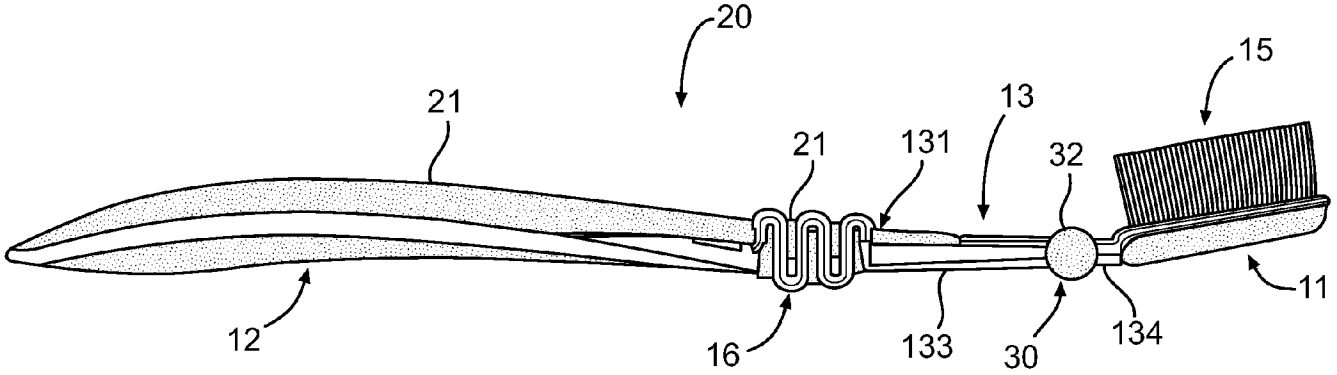
FIG. 2 shows a toothbrush of the invention in the same view direction as FIG. 1 with the thermoplastic elastomer present.
Figure 4:
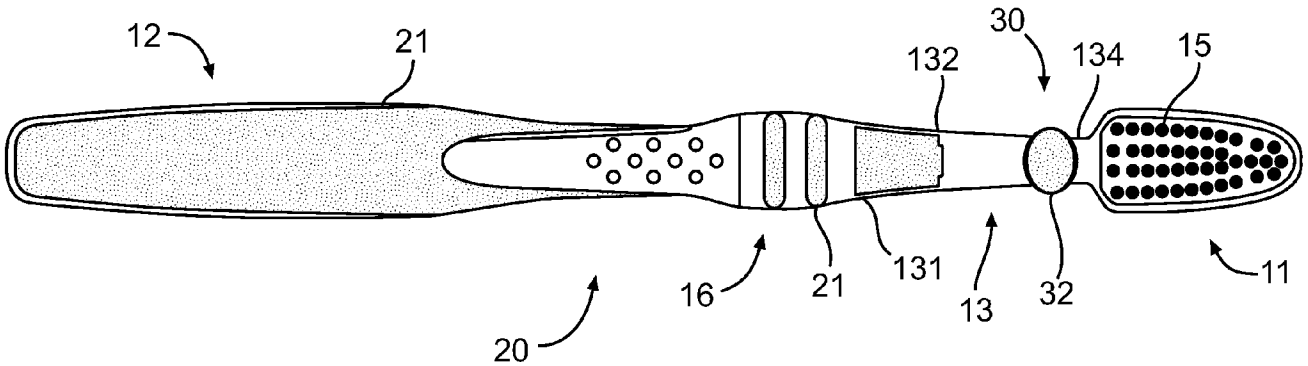
FIG. 4 shows a view of a toothbrush of FIG. 3 in the same view direction as FIG. 3 with thermoplastic elastomer material present.

FIGS. 2 and 4 show a toothbrush of the invention overall 20 including thermoplastic elastomer material 21 that extends over part of the grip handle 12 to enhance a user's grip.

Each trough 181, 182, 183 contains thermoplastic elastomer material 21 seen in FIGS. 2 and 4. The thermoplastic elastomer material is the commercially available material TF7 GST or TF7 GSN supplied by Kraiburg and having a ShoreA hardness 60-70. The thermoplastic elastomer material 21 is bonded to the plastic material of the limbs 161, 162, 163, 164. The thermoplastic elastomer material 21 occupies at least 75% of the transverse depth "D" and at least 75% of the width "W" of each trough 181, 182, 183.

At each longitudinal end of the undulating region 16 there is an end trough 184, 185 in the plastics material, which also contain thermoplastic elastomer material 21. These end troughs 184, 185 can act as a force-absorbing buffer between the neck region 13 at one longitudinal end of the undulating region 16, and the grip handle 12 at the other. The end trough 184 between the undulating region 16 and the grip handle 12 has a transverse depth "E1" of 5.5-6.5 mm, preferably ca. 6 mm, measured as shown in FIG. 5 between a longitudinal projection of the surface of the grip handle 12 and the opposite surface of limb 161, and has a longitudinal breadth "b" of 1-2 mm for all of its depth. The end trough 185 between the undulating region 16 and the neck region 13 has a transverse depth "E2" of ca. 6.0 mm, measured as shown in FIG. 5 between a longitudinal projection of the surface of the neck region 13 and the opposite surface of limb 164, and has a longitudinal breadth "b" of 1-2 mm for all of its depth.

As seen in FIGS. 2 and 4 these end troughs 184, 185 also contain the thermoplastic elastomer material of ShoreA hardness 60-70 bonded to the plastic material of the adjacent limbs 161, 164 and of respectively the grip handle 12 and the neck region 13, and occupying at least 75% of the transverse depth E1, E2 and at least 60% of the width of the end troughs 184, 185.

The toothbrush 20 of the invention also includes a flexible link 30 (overall) seen fully in FIGS. 2 and 4 situated longitudinally between the undulating region 16 and the toothbrush head 11. This flexible link 30 is situated in the neck region 13 thereby dividing the neck region 13 into two longitudinally separate parts 133, 134 on each longitudinal side of the flexible link 30, a first part 133 being closer to the grip handle 12, the second part 134 being closer to the head 11.

The flexible link 30 comprises a plastics material part 31 seen clearly in FIGS. 1 and 3, integral with the neck region 13, which is transversely and widthways thinned relative to longitudinally immediately adjacent parts of the neck region 13. This part 31 is in the form of a longitudinally extending spine of plastics material having a longitudinal dimension of 1-2 mm, a widthways dimension of 2-3 mm, and a transverse dimension of 1.5-2.5 mm. The cross section of the part 31 cut across the longitudinal direction is approximately circular.

The relative longitudinal proportions of the first part 133: second part 134, are approximately 8.25:1. These proportions are based respectively as the length of the first part 133 being the longitudinal distance from the edge of the end trough 185 closest to the head 11, to the end of the thinned part 31 closest to the grip handle 12 (this distance is ca. 28 mm), and the length of the second part 134 as the longitudinal distance from the end of the thinned part 31 closest to the head 11, to the point 131 where the neck region 13 begins to widen to form the head 11, this distance is ca. 3.5 mm. As seen in FIGS. 2 and 4 the thinned part 31 is surrounded around all of its transversely- and widthways-facing surfaces by thermoplastic elastomer material 32 having a spherical symmetry, with a spherical diameter of 6-7 mm. The thermoplastic material 32 is the same thermoplastic elastomer material 21 that is situated in the troughs 181, 182, 183, 184, 185.

The first part 133 of the neck region between the flexible link 30 and the undulating region 16 is constructed such that under the forces encountered during tooth brushing this first part 133 remains rigid relative to the flexibility of the flexible link 30 and the undulating region 16. This is achieved by the first part 133 having a transverse thickness "T" of at least 3.5 mm, being ca. 5 mm at the point 131 where the part 133 meets the undulating region 16 and 4-4.5 mm at the end of the first part 133 adjacent to the link 30. The first part 133 has a widthways width of at least 5 mm, being a width of ca. 9 mm at the point 131, and ca. 5.9 mm at the end of the first part 133 adjacent to the link 30.

In various places in the plastic material part 10, are apertures and moulding channels such as 40 into and through which the elastomer material 21 can flow from a single or multiple injection points to reach other parts of the plastic material part 10 of the toothbrush 20.

A toothbrush according to the above example was subjected to bending forces applied to the head and the stresses at various points in the toothbrush were measured. It was found that the structure and dimensions of the toothbrush described in the above example showed an acceptable degree of deformation in response to tooth brushing pressures. This toothbrush showed more deformation in its S-bend undulating region than in its brush head region thereby reducing potential breaking stress in the link between the head and handle. The deformation in the 5-bend undulating region during use was greater than in the S-bend region disclosed in the prior references mentioned above, with deformation concentrated in the limb 164 and fold 173 closest to the toothbrush head 11.

The invention claimed is:

1. A toothbrush comprising a head and a grip handle integrally made of a plastics material and arranged along a head-handle longitudinal direction, with a neck region between the grip handle and the head, with bristles projecting from the head in a transverse direction relative to this longitudinal direction, the toothbrush having a width direction perpendicular to the longitudinal direction and to the transverse direction, longitudinally between the neck region and the grip handle is an undulating region, comprising limbs extending in the transverse direction and integrally linked by folds with troughs between the limbs, the troughs between the limbs having a transverse depth direction and containing a thermoplastic elastomer material bonded to the plastic material of said limbs, wherein the transverse directions of longitudinally adjacent pairs of limbs are aligned at an angle of 0-15° to each other, each of the four limbs having a longitudinal thickness "T" of 1.2-2.2 mm, and a transversely extending length "L" of 9-13 mm between transversely opposite folds, and a width "W" of 9-14 mm in the width direction, the four limbs defining longitudinally between longitudinally adjacent pairs of the limbs three troughs each with a transverse depth "D" of 6-11 mm, a longitudinal breadth "B" of 1-2 mm for at least 60% of the lower depth of the trough, each trough containing the thermoplastic elastomer; and wherein the thermoplastic elastomer material has a ShoreA hardness of 60-70.

2. A toothbrush according to claim 1 wherein there are four limbs.

3. A toothbrush according to claim 1 wherein the thermoplastic elastomer material occupies at least 60% of the transverse depth "D" and at least 60% of the width of at least one trough.

4. A toothbrush according to claim 1 wherein at each longitudinal end of the undulating region there is an end trough in the plastics material, bounded on one longitudinal side by an adjacent limb and on the other longitudinal side by an adjacent surface of the grip handle or head, the end troughs also containing the thermoplastic elastomer material.

5. A toothbrush according to claim 1 wherein the neck region is flattened in the transverse direction.

6. A toothbrush according to claim 1 which also includes a flexible link situated longitudinally between the undulating region and the toothbrush head.

7. A toothbrush according to claim 6 wherein the flexible link is situated in the neck region thereby dividing the neck region into two longitudinally separate parts, one on each longitudinal side of the flexible link, being a first part closer to the grip handle and a second part closer to the head.

8. A toothbrush according to claim 7 wherein the relative longitudinal proportions of the first part:second part are in the range 8.5-8.0:1.

9. A toothbrush according to claim 6 wherein the flexible link comprises a part, integral with the neck region, which is transversely and/or widthways thinned relative to longitudinally immediately adjacent parts of the neck region.

10. A toothbrush according to claim 9 wherein the part which is transversely and/or widthways thinned is surrounded around all of its transversely- and widthways-facing surfaces by a thermoplastic elastomer material.

11. A toothbrush according to claim 10 wherein the thermoplastic elastomer which surrounds the thinned part has a spherical symmetry.

12. A toothbrush according to claim 6 wherein the part of the neck region between the flexible link and the undulating region is constructed such that under the forces encountered during tooth brushing this part remains rigid relative to the flexibility of the flexible link and the undulating region.

13. A toothbrush according to claim 1 wherein the plastic material has a modulus of elasticity of at least about 500 Mpa, and is a polyamide or polypropylene.

14. A toothbrush according to claim 1 wherein the thermoplastic elastomer material is a styrene-based thermoplastic elastomer.

* * * * *